United States Patent [19]

Barcus et al.

[11] 4,026,181

[45] May 31, 1977

[54] TENSION ROD

[76] Inventors: Lester M. Barcus, 16226 Wayfarer Lane, Huntington Beach, Calif. 92649; John F. Berry, 3392 St. Albans Drive, Los Alamitos, Calif. 90720

[22] Filed: July 7, 1975

[21] Appl. No.: 593,302

[52] U.S. Cl. ..... 84/291; 84/277

[51] Int. Cl.[2] ..... G10D 3/00; G10D 1/02

[58] Field of Search ..... 84/291, 276, 277, 267, 84/298, 299, 307

[56] References Cited

UNITED STATES PATENTS

| | | | |
|---|---|---|---|
| 703,572 | 7/1902 | Grienauer | 84/291 |
| 878,124 | 2/1908 | D'Armon | 84/277 |
| 1,750,843 | 3/1930 | Kirk | 84/291 |
| 1,788,745 | 1/1931 | Rowland | 84/276 |
| 1,897,531 | 2/1933 | Pasko | 84/277 |
| 2,145,978 | 2/1939 | Frazier | 84/276 |
| 2,162,595 | 6/1939 | Virzi | 84/277 |
| 2,236,701 | 4/1941 | Virzi | 84/277 |

FOREIGN PATENTS OR APPLICATIONS

| | | | |
|---|---|---|---|
| 1,126,710 | 3/1962 | Germany | 84/291 |

*Primary Examiner*—Stephen J. Tomsky
*Attorney, Agent, or Firm*—Albert L. Gabriel

[57] ABSTRACT

A tension rod for a string instrument such as a guitar is utilized to dampen flexural vibrations transferred to the instrument body while maintaining direct compressional wave coupling from strings to the instrument body.

14 Claims, 4 Drawing Figures

TENSION ROD

BACKGROUND OF THE INVENTION

1. Field of the Invention

The invention is in the field of tension rods for string musical instruments.

2. Description of the Prior Art

The terms "sonic" and "sound" are used herein to mean the complete spectrum of compression wave frequencies including audio frequencies and frequencies above and below the audio range.

It is traditional for string instruments such as guitars to have wooden braces positioned on the underside of the guitar top plate. Generally, a plurality of braces are provided which are positioned in a definite pattern on the instrument during its manufacture in order to improve and enhance the generated sound. In designing the brace pattern, the overall objective has been to reduce localized strain and distortion of the top plate while allowing and enhancing diaphragm movement and resonance.

As is quite apparent in inexpensive guitars, the decay of a note is not uniform, but rather has an undulating or a decreasing and increasing sound pattern, which sometimes will be referred to as "rollover". Rollover is thought to be associated with a feedback between the guitar body and the strings themselves via the bridge and saddle members. In guitars of excellent or outstanding quality, the discretely formed and carefully positioned wood bracings on the inside of the top plate of the guitar have the effect of reducing the rollover to some extent thereby providing a somewhat more uniform sound decay. However, a significant random, uncontrolled, vibratory feedback from the body to the strings still exists, and an undulating sound decay is still present even in the best quality instruments.

The conventional stringed instrument bridge presents an unstable platform for the strings which tends to vibrate with the strings, thereby having a muting effect on the upper partial frequencies, so that the strings may only vibrate in the fundamental and first few harmonics. Thus, the desired full spectrum of overtone frequencies is never produced in the instrument, and the quality of musical sounds produced by the instrument is seriously limited. This also causes an undesirably large proportion of low frequency sonic energy output of the instrument, with consequently generally poor carrying power.

The feedback of a flexural nature which occurs through the bridge of a guitar or other stringed instrument involves an undesired phase modulation which causes a cancellation effect that is detrimental not only to the dynamic amplitude and frequency, but also to the timbre. This undesirable modulation involves a phase shifting not only between the top and back plates of the instrument, but also between the strings and both the top plate and back plate. Timbre is affected in at least two ways: (1) the sine wave component of the sound is distorted, and (2) the formant structure of the tone is altered periodically during the decay.

On string instruments such as violins, it is conventional to utilize a sound post between the inner surfaces of the top and back plates of the instrument. Such sound posts are generally positioned adjacent the treble foot of the bridge and may apply outward force in opposition to the inward force exerted by the taut string members. Such sound posts have not been utilized in guitars, however, inasmuch as the physical dimensions and construction of the guitar have not so required, and it was heretofore thought desirable to maintain a large, relatively free and flexible surface for permitting diaphragm-like motions of the top plate and resulting resonances within the instrument body. Further, a sound post, which would be in compression between the top and back plates, incorporated in a guitar would tend to bow the top plate upwardly, which would enhance the upward biasing produced by the strings to an undesirable level and would correspondingly tend to relieve the string tension. Thus, although wooden braces are utilized in guitars to reduce localized strains and warping of the top plate, the desire for an overall diaphragm-like action has taught away from any utilization of a dampening means directly in the guitar bridge member itself.

In applicants' co-pending application, Ser. No. 533,221, filed Dec. 16, 1974, now U.S. Pat. No. 3,951,031 a solid rigid bridge is utilized in a guitar to reduce rollover and consequently provide a more uniform sound decay. A lead bridge member was found to provide the best dampening capabilities. An alternate solution to the rollover problem is provided by applicants' tension rod described hereinafter.

SUMMARY OF THE INVENTION

It is an object of the invention to provide a tension rod for a stringed instrument to substantially eliminate such rollover, and thus provide for more uniform sound decay.

It is another object of the invention to prevent vibratory feedback from the body of a musical instrument to the strings by utilizing a special rod element to decouple the flexural vibrations of the resonant body from the strings.

It is another object of the invention to stabilize the strings of a stringed instrument against the influence of flexural vibrations from the body to allow for a more uniform sound decay.

Another object of the invention is to isolate the top plate of the body of a stringed instrument from gross flexural vibrations of the strings to minimize undesired vibrations in the top plate, while nevertheless effectively transmitting from the strings to the top plate the sonic compressional wave energy which is the musical output of the instrument.

Another object of the invention is to provide an improved transfer medium for coupling sonic energy from the strings to the body of a stringed instrument.

A further object of the invention is to provide a stable platform for the strings of a stringed musical instrument, so as to provide a focal point for the accummulation of maximum sonic energy for transmission to the body of the instrument.

A further object of the invention is to eliminate undesirable phase shifting between the top and back plates of the instrument as well as to stabilize both the top and back plates against phase shifting relative to the strings of the instrument.

A still further object of the invention is to improve the high frequency response of a stringed musical instument.

A general object of the invention is to make a better sounding guitar or other stringed instrument that can be produced economically and consistently so that all instruments are generally uniform in musical quality.

The invention utilizes a tension rod to essentially isolate the top plate of a musical instrument from gross vibrations of the strings of the instrument and also to essentially isolate the strings from the gross flexural vibrations of the top plate of the instrument. The tension rod does not, however, diminish the sonic compressional wave energy coupling from the strings to the body for transmission of the musical sounds generated by the strings, and from the body back to the strings to achieve the desired timbre of the instrument. In fact, the tension rod appears to enhance sonic compressional energy coupling in that it stabilizes the bridge and top plate of the instrument relative to the sonic energy generating vibrations of the strings of the instrument. The effect of the tension rod is thus to enhance direct sonic energy coupling, particularly in the high frequency region, and reduce gross flexural vibrations, thus eliminating rollover and undesired phase modulation.

As a bridge member may be considered a region or channel of compressional energy flow from the strings to the instrument body, a direct dampening of flexural vibrations in this energy flow channel is much more effective in reducing rollover than prior techniques of relying entirely upon a plurality of wooden braces on the inside of the face of the instrument body. The method of discretely forming and positioning a plurality of wooden braces is cumbersome, time-consuming and expensive as every instrument must be individually and uniquely braced for optimum reduction of rollover. The method of dampening the flexural vibrations at the bridge is extremely simple and not dependent on the wood properties of the instrument body.

The tension rod of the instant invention also materially increases the effective acoustical energy generated by the strings by avoiding the dissipation of energy into useless gross flexural vibrations in the instrument, and this improvement is particularly emphasized in the important high frequency response of the instrument. Thus, the tension rod virtually eliminates the muting effect of the conventional vibratory bridge on the upper partial frequencies, permitting the strings to vibrate in all of their natural modes, e.g., even up to many harmonics, generating a full spectrum of overtone frequencies and thereby producing the full rich timbre of the highest quality instrument even in instruments generally considered to be of average or even poor quality. Because a substantial portion of the energy that would otherwise be in the form of lower frequency energy is thus converted into high energy upper partials which project or carry better, the overall output of the instrument has substantially greater projecting power.

BRIEF DESCRIPTION OF THE DRAWINGS

These and other objects of the invention will become more apparent in view of the following description wherein.

DESCRIPTION OF THE PREFERRED EMBODIMENT

Figure 1:
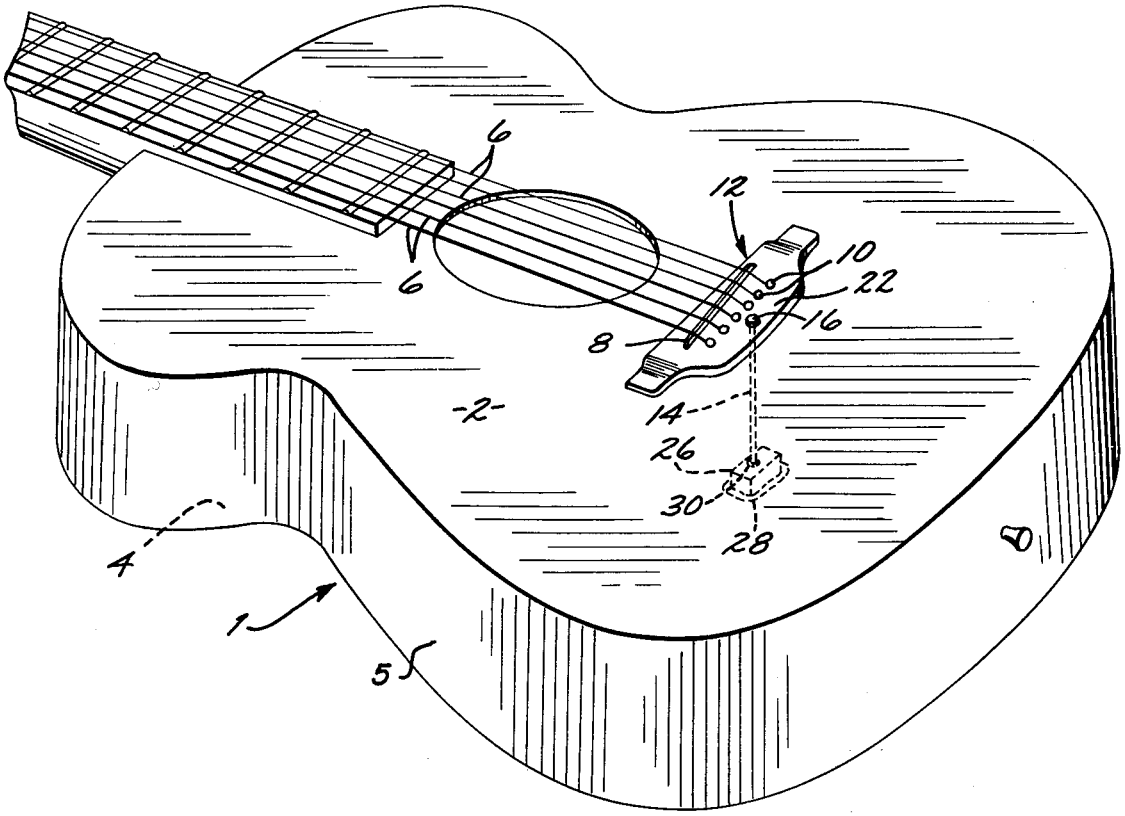
FIG. 1 is a perspective view of a guitar showing the tension rod of the invention.
Figure 2:
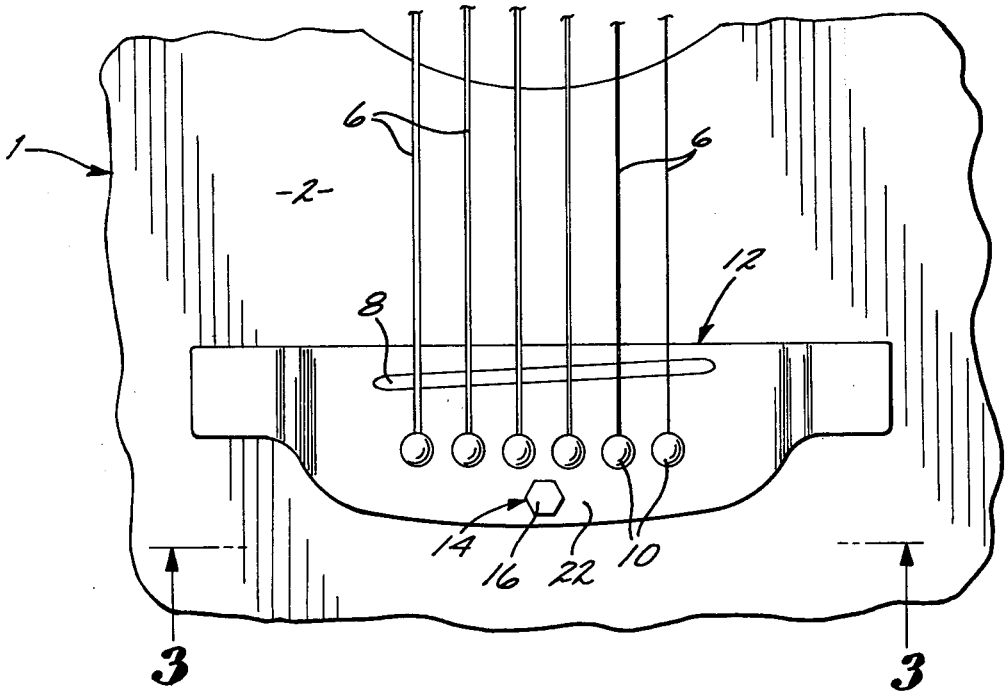
FIG. 2 is a partial plan view of the guitar bridge of FIG. 1.

FIG. 1 illustrates a partial view of a guitar showing the guitar body 1 of conventional design and having a top plate 2 and back plate 4 are connected by a side wall or rib 5. The guitar strings 6 are connected to a tuning head (not shown) and extend over a saddle member 8 to anchor pins 10. The saddle member 8 and anchor pins 10 are secured in a bridge 12 which is itself secured to the top plate 2 of the guitar by means of adhesive.

Figure 3:
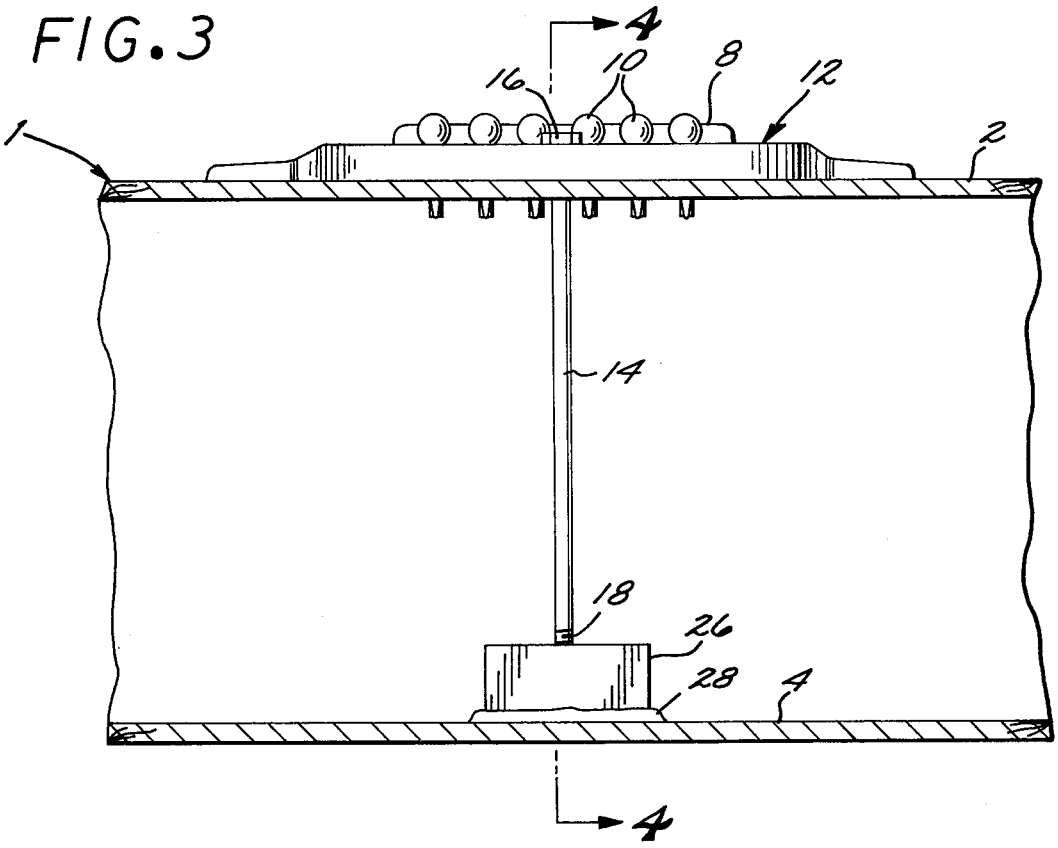
FIG. 3 is a partial cross-sectional view taken along lines 3—3 of FIG. 2.
Figure 4:
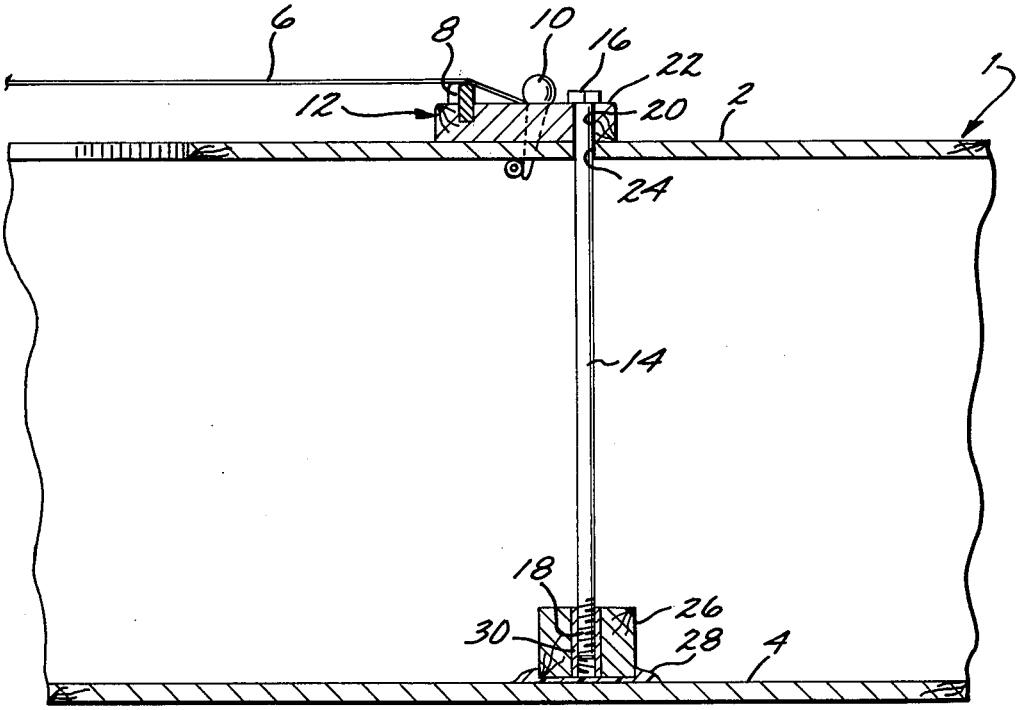
FIG. 4 is a partial cross-sectional view taken along lines 4—4 of FIG. 3.

As best seen in FIGS. 3 and 4, a tension rod 14 of the invention may be in the form of a long, slender bolt having a flat, hexagonal head 16 at one end and being threaded at its other end portion 18. Bolts of 10–32 and 8–32 thread sizes have been found to be satisfactory for the invention. An aperture 20 is provided in the side portion 22 of bridge 12 which extends toward the foot of the guitar, and an aligned aperture 24 is provided through the top plate 2 of the guitar. An anchor block 26 is secured by adhesive 28 to the inner surface of back plate 4 of the guitar directly below the aligned apertures 20 and 24, and the anchor block 26 supports an internally threaded collar 30 therein.

The threaded end portion 18 and shank of the tension rod bolt 14 are slidably engaged downwardly through the aligned apertures 20 and 24 and the threaded end portion is threadedly engaged in the collar 30 until the head 16 of the bolt bears downwardly against the exposed upper surface of the bridge 12. Tightening of the bolt head 16 down against the bridge 12 applies tension in the rod 14 to provide a biasing of the top plate 2 and back plate 4 toward each other.

A suitable amount of tension is introduced into the rod 14 for the purpose of the present invention by simply tightening the exposed bolt head 16 between the thumb and forefinger.

If desired, the bolt head 16 may be countersunk in the bridge 12 and tightening thereof may be accomplished by a suitable insertion tool, such as a socket wrench. If the bolt head 16 is thus countersunk, a pearl dot (not shown) may be utilized to cover the bolt head 16 to provide an attractive decor.

In operation, the saddle member 8 provides a low impedance coupling of the sonic compressional energy of the strings directly to the bridge 12. The tension rod 14 acts to dampen the gross flexural motions of the top plate 2 and also gross vibratory motions of the bridge 12 without hampering effective transmission of sonic compressional energy from the strings to the top plate of the guitar itself, as well as some desirable feedback sonic compressional energy from the top plate to the strings.

The tension rod 14 serves the further important function of tying the top plate 12 and back plate 4 together against phase shifting therebetween, as well as stabilizing both the top and back plates against phase shifting relative to the strings 6.

In a conventional guitar such as the guitar 1 there is a natural tendency for the cumulative tension of the strings 6 to bow the top plate 2 upwardly, and this in turn tends to loosen the strings. If the bridge 12 is not properly anchored to the top plate 2, the twisting force which the string tension applies to the bridge as best visualized in FIG. 4 may sometimes even result in the bridge 12 being torn loose from the top plate 2. The tension rod 14 serves the further function of opposing and compensating for the tendency of the string tension to bow the top plate 2 upwardly; and by connecting the upper end of the tension rod 14 to the side of the bridge 12 that is located toward the foot portion of the guitar from the anchor pins 10, the tension rod 14 has a counterbalancing effect against the tendency of the string tension to twist the bridge 12 loose from the top plate 2.

It is found in practice that rather than the expected dampening of the sonic output of the instrument, the output amplitude is actually increased, particularly in the upper partial frequency ranges.

While the invention has been particularly shown and described with reference to a preferred embodiment thereof, it will be understood by those skilled in the art that various changes in form and details may be made therein without departing from the spirit and scope of the invention.

We claim:

1. A stringed instrument comprising:

a. a resonant body having a top plate, a back plate, and a peripheral rib, b. bridge means positioned on said top plate for contact with string members of said stringed instrument, and c. means connected between said back plate and said bridge means for adjustably tensioning said top plate toward said back plate.

2. A stringed instrument as recited in claim 1 wherein said tensioning means comprises a rigid rod member connected to said bridge means and back plate.

3. A stringed instrument as recited in claim 2 wherein said rigid rod member is a bolt.

4. A stringed instrument as recited in claim 2 wherein said top and back plates are generally planar and spaced apart, said bridge means has an aperture therein, and said rod member extends into said aperture and is oriented substantially normal to said top and back plates.

5. A stringed instrument as recited in claim 1 wherein said stringed instrument is a guitar.

6. A stringed instrument as recited in claim 5 wherein said tensioning means is connected to said bridge means at a location spaced toward the foot end of the guitar from the location where the strings are anchored to said bridge means.

7. A stringed instrument comrpising:

a. a resonant body having a top plate, a back plate, and a peripheral rib, b. bridge means positioned on said top plate for contact with string members of said stringed instrument, and c. means for tensioning said top plate toward said back plate, said tensioning means being connected between said top and back plates at a position spaced from said rib.

8. A stringed instrument as recited in claim 7 wherein said tensioning means is positioned proximate said bridge means.

9. A stringed instrument as recited in claim 8 wherein said tensioning means is connected to said bridge means.

10. A stringed instrument as recited in claim 9 wherein said tensioning means is connected to said bridge means at a location spaced toward the foot end of the guitar from the location where the strings are anchored to said bridge means.

11. A stringed instrument as recited in claim 7 wherein said tensioning means is adjustable.

12. A stringed instrument as recited in claim 7 wherein said tensioning means comprises a rigid rod member connected to said top and back plates.

13. A stringed instrument as recited in claim 12 wherein said top and back plates are generally planar and spaced apart, and said rod member is oriented substantially normal to said top and back plates.

14. A stringed instrument as recited in claim 7 wherein said stringed instrument is a guitar.

* * * * *